US006874285B2

(12) United States Patent
Wilson

(10) Patent No.: US 6,874,285 B2
(45) Date of Patent: Apr. 5, 2005

(54) DOMED BUILDING CONSTRUCTION SYSTEM

(75) Inventor: Arnold Wilson, 415 E. Maple St., Mapleton, UT (US) 84664

(73) Assignee: Arnold Wilson, Mapleton, UT (US)

( * ) Notice: Subject to any disclaimer, the term of this patent is extended or adjusted under 35 U.S.C. 154(b) by 171 days.

(21) Appl. No.: 10/266,156

(22) Filed: Oct. 8, 2002

(65) Prior Publication Data

US 2004/0065026 A1 Apr. 8, 2004

(51) Int. Cl.[7] ..... E04B 1/32
(52) U.S. Cl. ..... 52/80.1; 52/82
(58) Field of Search ..... 52/80.1, 82, 72, 52/536, 592.1, 537

(56) References Cited

U.S. PATENT DOCUMENTS

| | | | | | |
|---|---|---|---|---|---|
| 968,061 | A | * | 8/1910 | Kramer | 52/82 |
| 1,907,268 | A | * | 5/1933 | Schwemlein | 220/693 |
| 3,546,826 | A | * | 12/1970 | Chapman | 52/23 |
| 3,999,337 | A | * | 12/1976 | Tomassetti et al. | 52/82 |
| 5,896,709 | A | * | 4/1999 | Pope | 52/90.1 |
| 6,324,791 | B1 | * | 12/2001 | Azpiroz Villar | 52/80.1 |

* cited by examiner

*Primary Examiner*—Peter M. Cuomo
*Assistant Examiner*—Stephen Vu

(57) ABSTRACT

A domed building or mold constructed with flexible, light-weight curved panels snapped together using grooves and ridges formed in the panels to form a building wall, a tension ring holding the panels in place and a top cap overlying and secured to upper edges of the panels

11 Claims, 7 Drawing Sheets

DOMED BUILDING CONSTRUCTION SYSTEM

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The desirability of domed shaped building structures has long been recognized. The Eskimo people of the arctic, for example, have long formed building structures from curved blocks of snow and ice. More recently, very large domed stadiums have been constructed throughout the world. U.S. Pat. No. 5,918,438 and the patents cited therein, disclose various types of domed structures and methods of construction of such structures. U.S. Pat. No. 5,918,438 discloses a method of constructing a domed structure using an inflatable form having a peripheral edge anchored to a base. A network of cable-like members that overlie the form is anchored to the base to limit expansion and tearing of the form. A layer of foam is applied to the interior of the form, followed by attachment of reinforcing mesh. A cementitious material is applied to embed the mesh. Internal ribs are formed to underlie the network of external cable members which may be connected to the internal ribs to assist in support of the ribs until they become self-supporting of the dome.

Domed structures are often preferred because of their superior strength characteristics and low construction costs relative to other types of buildings. Domed buildings can often be manufactured at costs well below that of buildings having comparable interior spaces.

Nevertheless, it is desirable to have even better ways (i.e. lower cost and easier methods of construction) to construct domed buildings and particularly smaller buildings up to the size of garages and small warehouses.

Accordingly, it is a principal object of the present invention to provide a method of constructing smaller domed buildings (i.e. small homes, garages, warehouses, outbuildings, and the like) with lower labor costs and other features that will result in significant cost savings in the construction of buildings, on site.

Another object is to provide a domed building that will, if so desired serve as an inner shell form for a concrete outer shell poured over the inner shell and with panels forming the inner shell being made of lightweight plastic and removable from the concrete outer shell into the interior of the structure formed by the inner and outer shells.

It is a principal feature of the method of the invention that lightweight, formed panels be used either to form a building shell or to serve as an inner support mold for cementitious material applied over the support mold.

After being used as a support mold the panels are removed from the concrete building shell and are available for re-use.

Additional objects and features of the invention will become apparent to those skilled in the art to which the invention pertains from the following detailed description and drawings.

DETAILED DESCRIPTION OF THE INVENTION

Figure 1A:
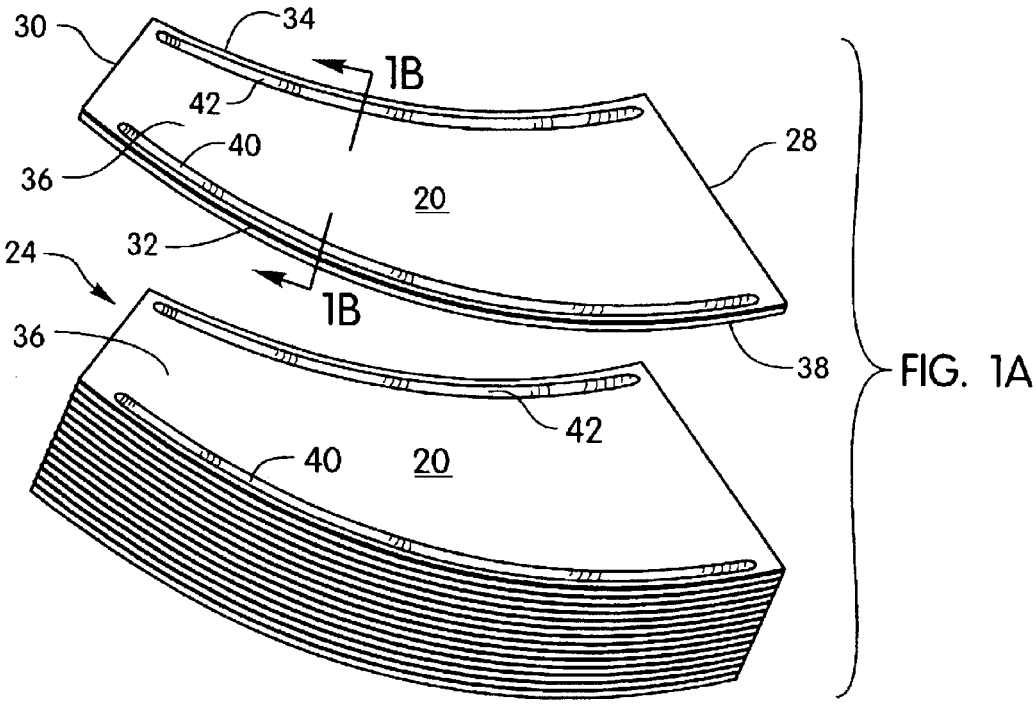
FIG. 1A is a perspective view of a bundle of typical building panels used to construct a domed building of the invention and with one panel exploded from the bundle to show greater detail of a typical panel.
Figure 1B:
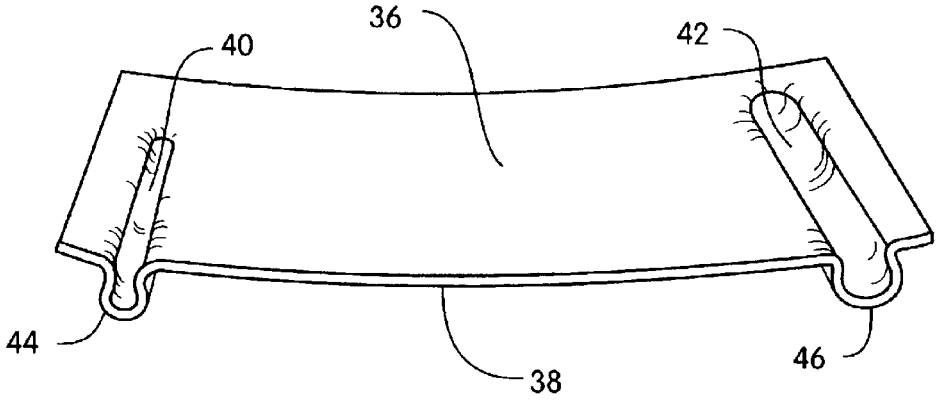
FIG. 1B, a transverse section through a building panel, taken on the line 1B—1B of FIG. 1A.
Figure 2:
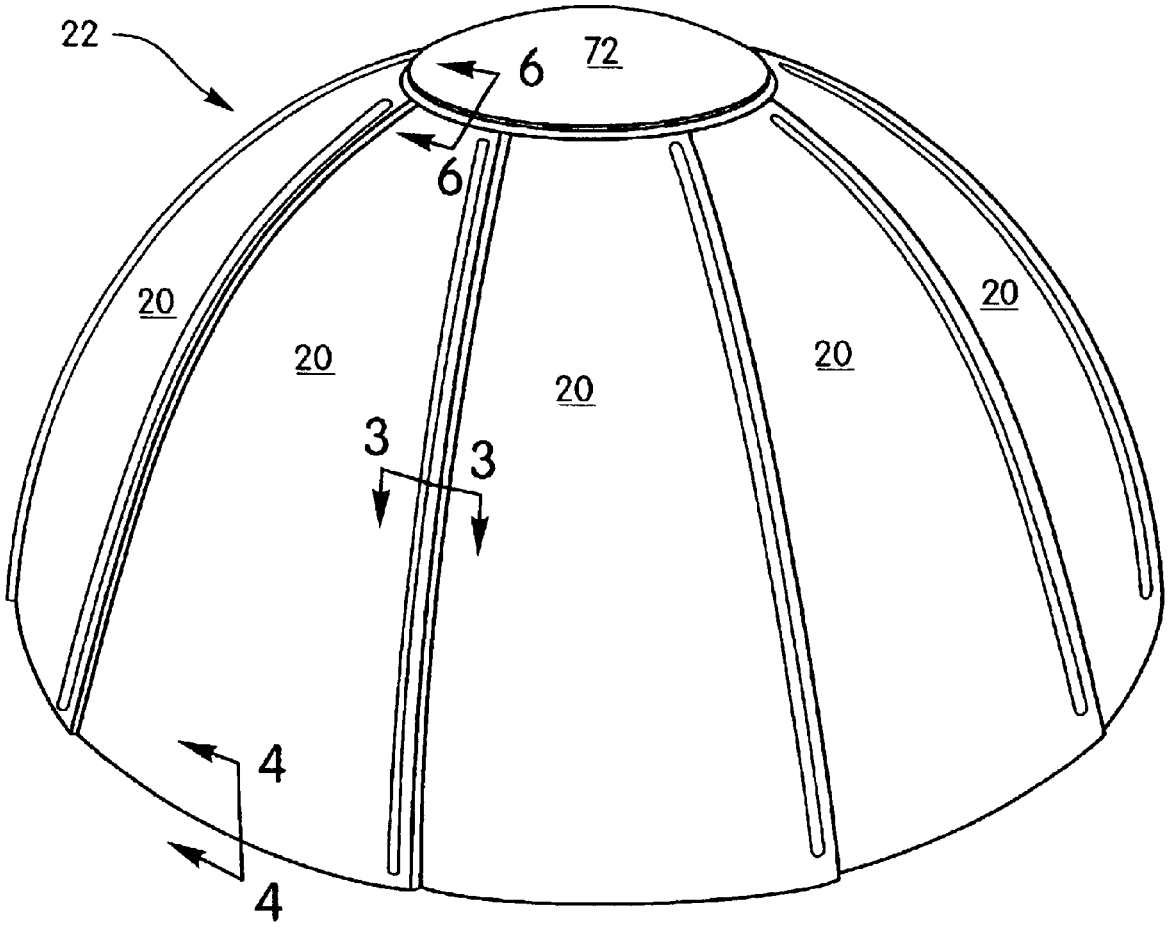
FIG. 2, a perspective view of a typical domed building constructed using the panels of FIG. 1A.
Figure 3:
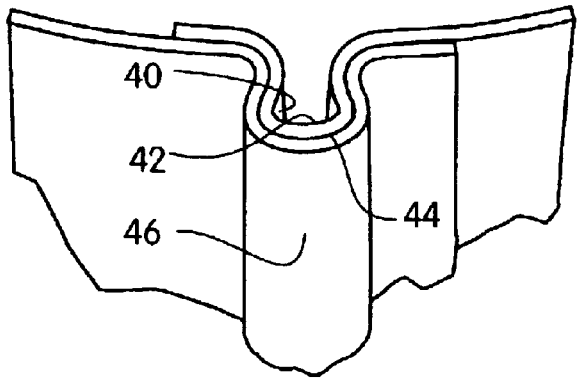
FIG. 3, an enlarged fragmentary section view, taken on the line 3—3 of FIG. 2.

Referring now to the drawings:

In the illustrated embodiment of the invention shown in FIGS. 1–6, lightweight, but durable, building panels 20 are interlocked to construct a building, shown generally at 22 (FIG. 2). As best shown in FIG. 1, the building panels 20 are readily stacked together to form a bundle 24 that is easily carried stored, transported and neatly arranged at a building site. Preferably, the building panels 20 are molded from a suitable sun-resistant plastic and the panels have some limited flexibility while returning to their molded shape. Polyurethane plastics have been found to be well suited for the purpose. The panels 20 are identical and each has a bottom edge 28 and a top edge 30. Opposite sides 32 and 34 of each panel 20 are flared from the top edge 30 to the bottom edge 28. Each panel 20 has an inner face 36 and an outer face 38. The panel 20 is curved from top end 30 to bottom end 28 and from side 32 to side 34 such that the inner face 36 is concave while the outer face 38 is of convex configuration.

A short groove 40 is formed in the inner face 36 and extends parallel to the side 32 and a long groove 42 is formed in the inner face 36 parallel to the side 34. The short and long grooves 40 and 42 on the inner face 36 respectively become short and long ribs 44 and 46 on the outer face 38 of the panel.

The short groove 40 of each panel 20 extends from just adjacent to the top and bottom edges 30 and 28 of the panel and the short rib 44 of each panel has a length just shorter on both ends than the long rib 46. Each groove 42 has a C-shaped cross sectional configuration with a width that is just wider than each groove 40 so that when a rib 44 is forced to snap into a groove 42 the rib is tightly clamped and frictionally held in place in the groove.

The lengths of the sides 32 and 34, and the top and bottom edges 30 and 28, the curvature between sides 32 and 34 and the curvature between the top and bottom edges are all selected such that when the panels 20 are interconnected the wall of a domed building 22, having a desired size, will be formed.

A bottom tension ring 50 is provided at the inside bottom edges 28 of the interconnected panels 20. The tension ring 50 may be formed of other materials having a natural spring effect biasing the ring open. However for small structures it has been found that a length of polyurethane plastic conduit 52 bent into a circle and held together by a pin structure 54 inserted into opposite ends 56 and 58 of the conduit provides a very suitable tension ring.

While other pin structures can be used to interconnect the conduit ends 56 and 58, pin structure 54 includes a pair of spaced apart insert pins 60 and 62 interconnected by a door threshold 54. Door threshold 54 is curved to conform to the curvature of the plastic conduit 52.

Door threshold 54 also includes a curved groove 66 to receive and guide a bottom edge 28 of a panel 20 that will serve as a sliding door 70 for the building 22. The sliding door 70 will slide from a position closing the space between adjacent panels 20 forming the building wall to an open position wherein the sliding door at least partially overlies one of the adjacent panels.

A flexible cap 72 fits over the top edges 30 of the interconnected panels 20. Cap 72 includes a brim 74 overhanging the interconnected panels 20 forming the wall of building 22 and the top edge 30 of the panel 20 forming door 70. Clips 76 formed on the bottom surface of cap 72 snap into engagement with the inside surface of the interconnected panels 20 at top edges 30. The top edge 30 of panel 20 of the sliding door 70 is guided between an interconnected panel 20 and the overhanging brim 74 of cap 72.

The bottom edge 28 of each interconnected panel 20 is inserted into one or more anchor clips 80 having a U-shaped spring clip portion 82 to receive the bottom edge 30 and a C-shaped resilient clip portion 84 through which the flexible conduit 52 is inserted.

Figure 4A:
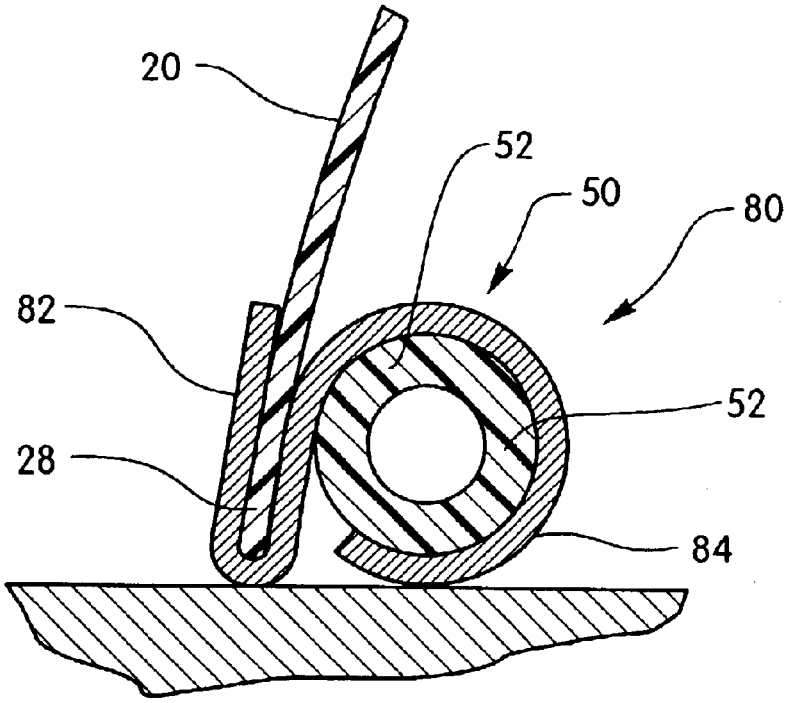
FIG. 4A, an enlarged fragmentary vertical section, taken on the line 4A—4A of FIG. 2 and showing one embodiment of clip used to secure the panels to a base ring.
Figure 4B:
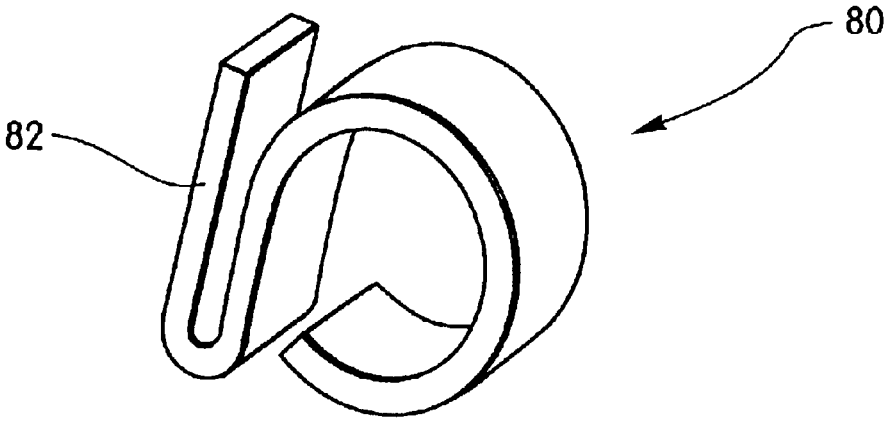
FIG. 4B, a still further enlarged perspective view of the clip of FIG. 4A.
Figure 4C:
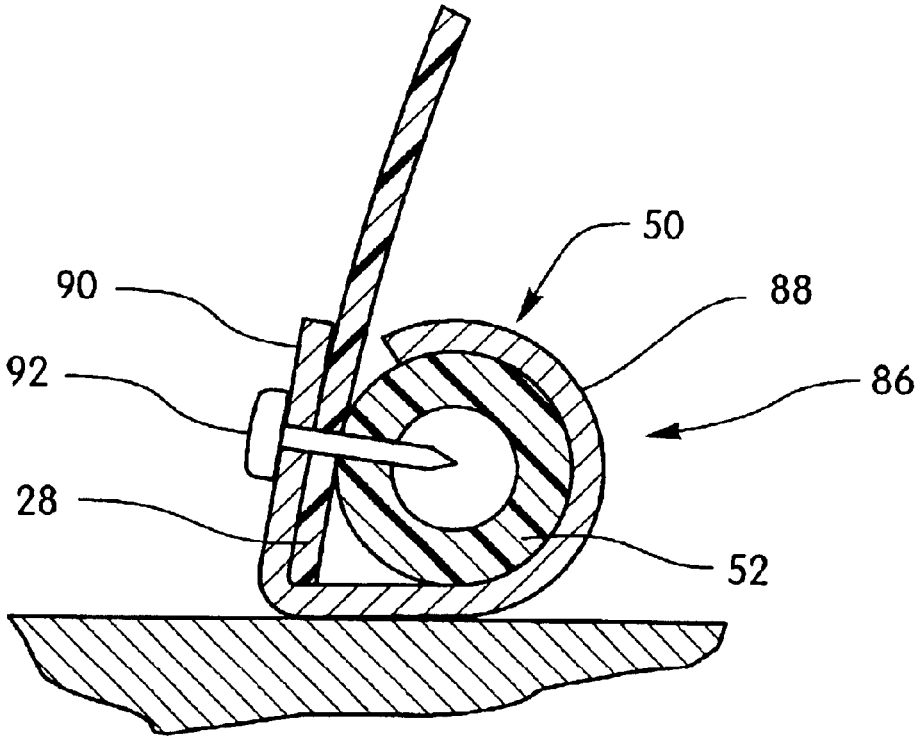
FIG. 4C, a view like that of FIG. 4A, but showing an alternate embodiment of clip.
Figure 4D:
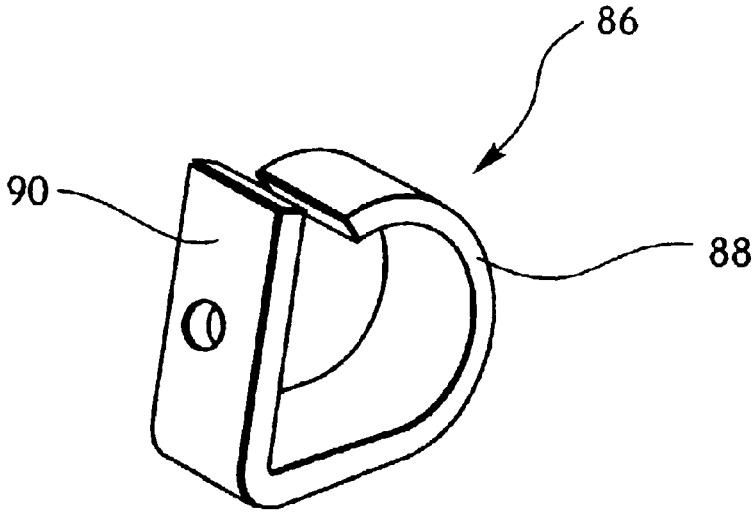
FIG. 4D, a view like that of FIG. 4B, but showing the clip of FIG. 4C.

An alternate embodiment of clip used to secure the interconnected wall panels 20 to the expansion ring 50 is shown in FIGS. 4C and 4D. As shown, clip 86 includes a C-shaped portion 88 and an upstanding leg 90. In use, the conduit 52 of expansion ring 50 is inserted through the C-shaped portion 88 and the bottom edge 28 of an interconnected panel 20 is positioned between the conduit 52 and the upstanding leg 90. A screw 92 is inserted through a hole 94 in leg 90 and is threaded into and through the edge 36 and into conduit 52.

Figure 4E:
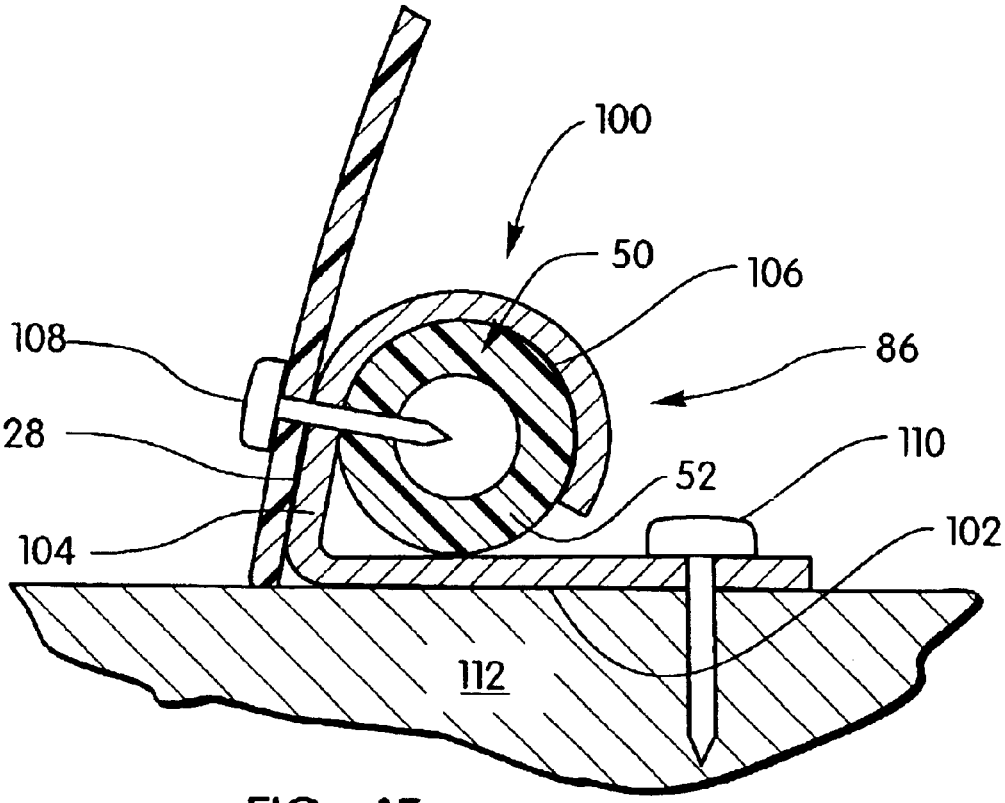
FIG. 4E, a view like that of FIG. 4A, but showing still another embodiment of clip.
Figure 4F:
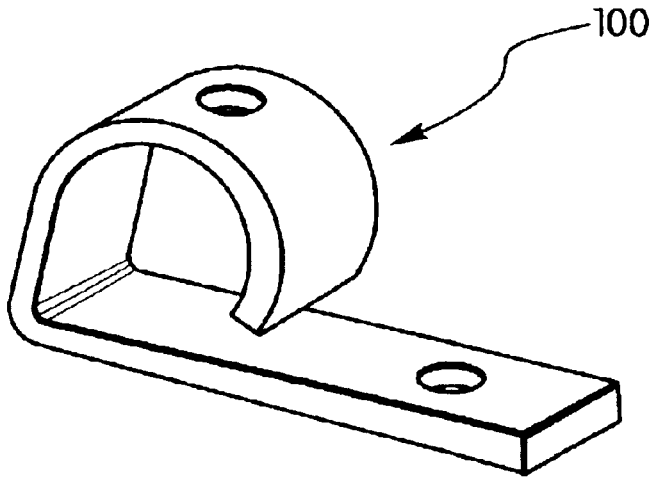
FIG. 4F, a view like that of FIG. 4B, but showing the clip of FIG. 4E.
Figure 5:
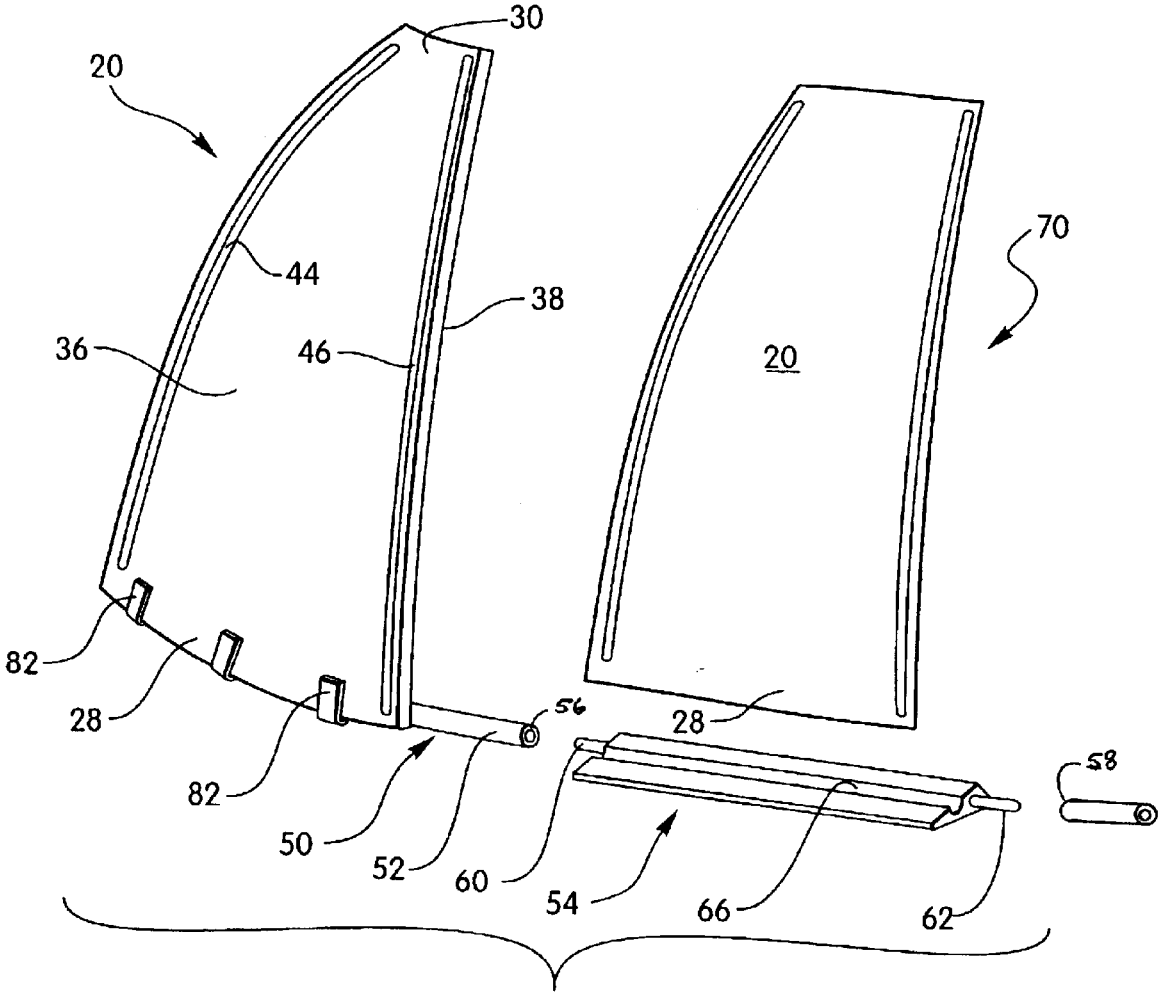
FIG. 5, a fragmentary exploded perspective view of a door threshold and a door of the building of the invention.
Figure 6:
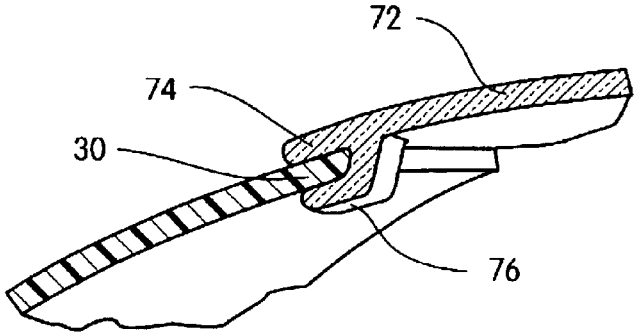
FIG. 6, a vertical section, taken on the line 6—6 of FIG. 2.

Still another embodiment of clip used to secure the interconnected wall panels to the expansion ring 50 is shown at 100 in FIGS. 4E and 4F. Clip 100 has a horizontal leg 102 that extends from one end of an upright leg 104. The other end of leg 104 is formed to have a C-shaped portion 106 through which conduit 52 of expansion conduit 50 is inserted. The lower edge 28 of an interconnected wall panel 20 is positioned against the upright leg 104 and is secured by a screw 108 to the upright leg and the conduit 52. An anchor screw 110 passes through the horizontal leg 102 and into a concrete slab 112 or other floor material used with the building 22.

Panels 20 and cap 72 may be opaque, translucent, or transparent, as desired. One or more panel 20 may be used as a window and the cap may act as a skylight.

Figure 7:
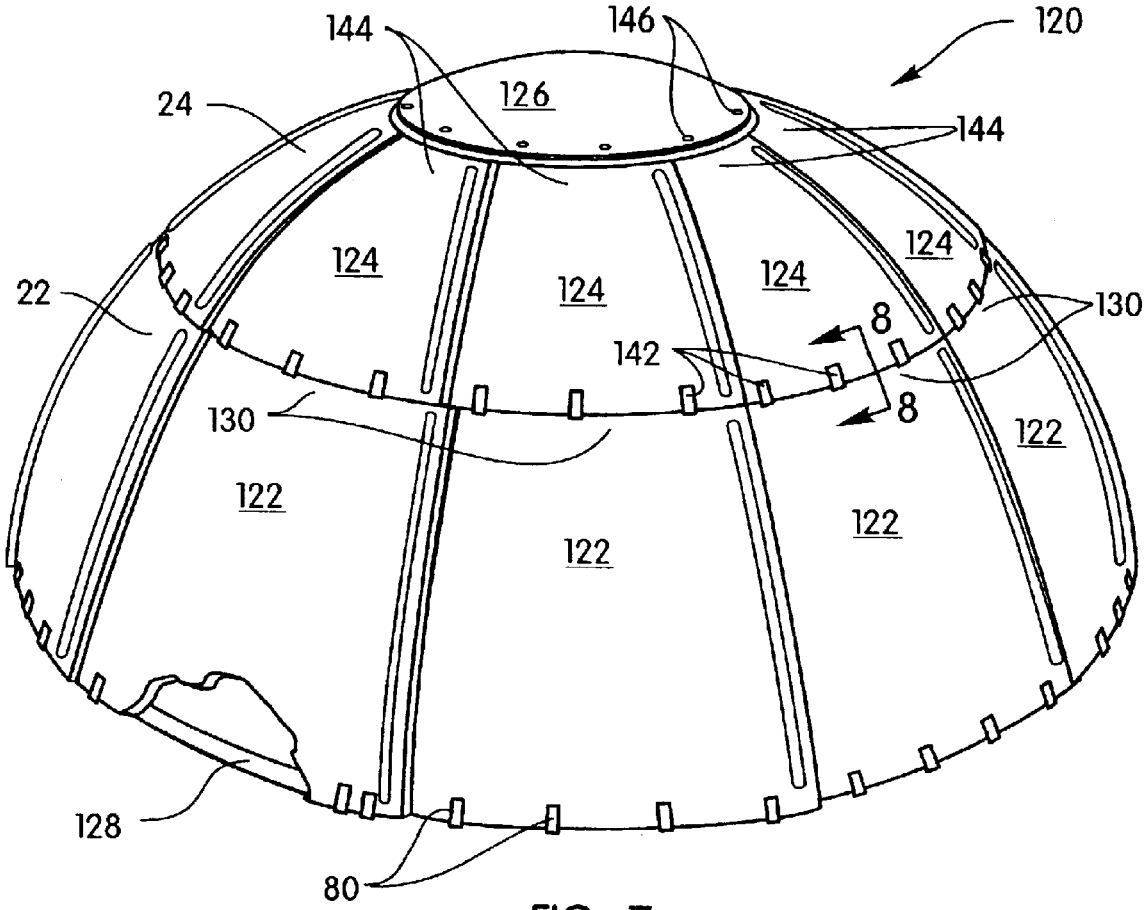
FIG. 7, a perspective view of another building constructed using the preferred embodiment of apparatus of the invention.
Figure 8:
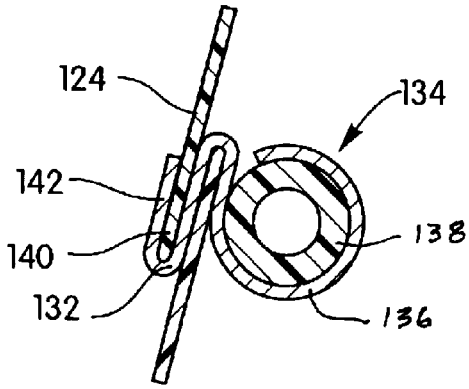
FIG. 8, a horizontal section, taken on the line 8—8 of FIG. 7.

Larger buildings, such as shown generally at 120 in FIG. 7, can be constructed using larger panels 122 snapped together to form a lower wall section topped with smaller snapped together panels 124 forming an upper wall section and a top cap 126. Panels 122 and 124 are constructed in the same manner as panels 22 previously described and are secured to a bottom expansion ring 128 using anchor clips 80, or such other anchor clip as may be selected. Upper edges 130 of the panels 122 are inserted into down turned hooks 132 of anchor clips 134 having loops 136 through which a tension ring 138 is inserted. Bottom edges 140 of the snapped together panels 124 are inserted into up turned hooks 142 of the anchor clips 134.

Once constructed, either building 22 or building 120, can also be used as an inside mold for a concrete domed structure poured over the outside of the building. Once the concrete has sufficiently cured, the building/mold can be left in place or can be stripped away from inside the building to be used again as either a building or a mold.

Top cap 126 is secured to the upper edges 144 of panels 124 as by screws 146.

Although preferred embodiments of the invention have been herein disclosed, it is to be understand that such disclosure is by way of example and that other variations are possible without departing from the subject matter coming within the scope of the following claims, which claims define my invention.

What is claimed is:

1. A domed building comprising:

a plurality of interconnected flexible, shape retaining panels, wherein each of the panels includes a top edge, a bottom edge, a pair of spaced apart side edges, wherein each of the side edges is flared outwardly from said top edge to said bottom edge, a concave inner face and a convex outer face, a pair of elongate grooves extending into said inner face and forming a pair of ribs projecting from said outer face, said ribs and grooves each extending parallel to one of said side edges, and with one of said grooves with one of said ribs of each of said panels being sufficiently longer and sufficiently larger than the other rib with the groove of an adjacent said panel inserted into one of said grooves to be frictionally held therein, whereby said interconnected panels form a domed building wall.

2. The domed building as in claim 1, further including a top cap fitting over an upper edge of at least some of said panels; and means securing said top cap in place secured to at least one of said panels.

3. A domed building comprising:

a plurality of interconnected flexible, shape retaining panels, wherein each of the panels includes a top edge, a bottom edge, a pair of spaced apart side edges, wherein each of the side edges is flared outwardly from said top edge to said bottom edge, a concave inner face and a convex outer face, a pair of elongate grooves extending into said inner face and forming a pair of ribs projecting from said outer face, said ribs and grooves each extending parallel to one of said side edges, and with one of said grooves with one of said ribs of each of said panels being sufficiently longer and sufficiently larger than the other rib with the groove of an adjacent panel said inserted into one of said grooves to be frictionally held therein, whereby said interconnected panels form a domed building wall;

a top cap fitting over an upper edge of at least some of said panels;

means securing said top cap in place secured to at least one of said panels;

a base ring; and means securing at least some of said panels to said base ring.

4. The domed building as in claim 3, wherein said base ring is a tension ring biasing the bottom edges of said panels outwardly.

5. The domed building as in claim 4, wherein said tension ring is formed from a flexible plastic conduit having pin means inserted into ends of said conduit to bold said conduit in a circular configuration.

6. The domed building as in claim 5, wherein said pin means includes a threshold with pins projecting from opposite ends thereof to extend into opposite ends of the conduit and a groove extending into a face of said threshold and across said threshold adjacent to said pins.

7. The domed building as in claim 6, wherein said threshold spans between a pair of wail panels and said groove receives the bottom edge of another said wall panel to slide in said groove as a sliding door panel for the domed building.

8. The domed building as in claim 7, wherein at least one of said panels forming the building wall is transparent to serve as a window for the building.

9. The domed building as in claim 7, wherein the cap is transparent to serve as a skylight for the building.

10. The domed building as in claim 7, wherein the cap includes a brim extending over and spaced from the top edge of each of the interconnected panels, to guide sliding of the top edge of the sliding door panel.

11. A domed building as in claim 5, wherein the panels are secured to the tension ring by attachment clips, each of said clips including a portion at least partially encircling the tension ring and a spring clip receiving the bottom edge of a panel.

* * * * *